United States Patent [19]

Dyrén et al.

[11] Patent Number: 4,504,386

[45] Date of Patent: Mar. 12, 1985

[54] SCREENING APPARATUS FOR WOOD CHIPS

[75] Inventors: Karl E. A. Dyrén; Gustaf S. Strandberg, both of Örnsköldsvik, Sweden

[73] Assignee: KMW Aktiebolag, Karlstad, Sweden

[21] Appl. No.: 609,743

[22] Filed: May 14, 1984

[30] Foreign Application Priority Data

May 16, 1983 [SE] Sweden ..... 8302742

[51] Int. Cl.[3] ..... B07B 1/30

[52] U.S. Cl. ..... 209/254; 209/315; 209/320; 209/329; 209/379; 209/396; 209/405; 209/674

[58] Field of Search ..... 209/315, 396, 393, 384, 209/394, 395, 379, 400, 674, 675, 677, 678, 412, 405, 254

[56] References Cited

U.S. PATENT DOCUMENTS

| | | | |
|---|---|---|---|
| 281,115 | 7/1883 | Motley | 209/396 X |
| 810,922 | 1/1906 | Dickey | 209/396 |
| 1,552,397 | 9/1925 | Edwards | 209/396 X |
| 1,606,301 | 11/1926 | Jones | 209/396 |
| 1,608,640 | 11/1926 | Wilson | 209/396 |
| 2,020,800 | 3/1933 | Roger | 209/396 |
| 2,128,603 | 12/1936 | Davies | 209/396 |
| 4,301,930 | 11/1981 | Smith | 209/671 |

FOREIGN PATENT DOCUMENTS

| | | |
|---|---|---|
| 0516455 | 1/1931 | Fed. Rep. of Germany . |
| 1042481 | 11/1958 | Fed. Rep. of Germany . |

*Primary Examiner*—Tim Miles
*Assistant Examiner*—Thomas M. Lithgow
*Attorney, Agent, or Firm*—Bell, Seltzer, Park & Gibson

[57] ABSTRACT

An apparatus is disclosed for screening and separating wood chips or the like according to thickness. In the illustrated embodiment, the apparatus comprises two generally horizontal decks mounted one beneath the other, and with each deck having three screening sections disposed in a serial arrangement along its longitudinal length. Each screening section comprises an opening in the associated deck, a stationary grid composed of parallel rod elements disposed in the opening, and a movable grid which is also composed of a plurality of rod elements and which are disposed in alternating relation with the rod elements of the stationary grid. Further, the grids are arranged so that the gaps between the rod elements are parallel and of predetermined uniform separation throughout. A drive unit is provided for reciprocally moving the movable grid of each screening section, while maintaining the predetermined gap separation, and so that the chips are tossed upwardly and longitudinally toward the discharge end of the apparatus, with the chips having a thickness less than the gap separation falling therethrough.

17 Claims, 4 Drawing Figures

SCREENING APPARATUS FOR WOOD CHIPS

The present invention relates to a screening apparatus for separating particulate material, and specifically wood chips, according to thickness, to facilitate subsequent processing of the chips.

The chips produced by various types of wood in chipping machines vary considerably in size and shape. However, for the digesting process in the production of cellulose, it is desirable that the chips supplied have a uniform thickness in order to achieve optimum yield and low shives in the pulp, i.e., a pulp which contains a low percentage of undigested fibers. Under normal conditions of digesting, the pulping liquid penetrates into the chips to a depth of about 4 mm. Thus, a chip having a thickness greater than about 8 mm will contain an untreated core of undigested fibers after the digesting process. Thus, to ensure proper digestion of the chips in the production of paper pulp, the supply should not contain any chips having a thickness which may give rise to the above-noted problem during the digestion process.

The chips supplied from the chipping process of conventional chipping machines also contain fine materials in the nature of sawdust, which normally should also be separated from the chips delivered to the digesting process.

Present apparatus for screening wood chips by thickness are of the disc screen type, and comprise a plurality of generally circular discs mounted on parallel rotating shafts. The discs are mounted coaxially on each shaft and spaced from each other, and the discs mesh with the discs of the adjacent shafts to form screening gaps between the discs of one shaft and those of the adjacent shafts. One drawback associated with such disc screening apparatus is the fact that the effective screen area is necessarily limited, and the number of shafts provided with the discs will therefore be large in an industrial installation requiring substantial production capacity. Also, by reason of the precision requirements of the gaps between the discs, the manufacturing costs are relatively high. Further, since the discs mesh with each other and have counter-rotational movement in the screening area, there is friction between the surfaces which mesh with each other due to the material to be screened becoming lodged between the discs, and also by reason of resin deposits on the discs. It has been found that this friction is one of the main causes of the high power requirement of such screening apparatus. It has also been found that it is difficult to maintain a uniform gap width during operation of such apparatus, since the discs may not be mounted exactly at right angles, and they therefore flutter with respect to each other during operation. A further disadvantage of the above apparatus is the fact that the chips are only fed at one location and the flow of chips across the cross-sectional area of the apparatus may be so high above the screening area that the uppermost layer may be transported across the screening area without ever coming into contact with it. Consequently, the uppermost layer is advanced forwardly without being screened. The disc screening apparatus are also highly sensitive to sand, stones and scrap, and are therefore subject to wear. To reduce such wear it has been common to plate the discs with hard chromium. Examples of disc screening apparatus of the above-described type may be found in Swedish Published Specification No. 7712674-6 and U.S. Pat. No. 4,301,930.

As illustrated, for example, in U.S. Pat. Nos. 2,020,800 and 2,128,603, German Specification Nos. 516,455 and 1,042,481, a screening apparatus is also known which comprises two grids mounted for relative movement. One of the grids includes transverse and longitudinal elements which, together with the elements of the other grid, produce the apertures of the screen. Such screening apparatus thus sort material according to two dimensions and are not adapted to be used to thickness screen wood chips, since among other things, a considerable quantity of the chips having the correct thickness to be screened will be entrained by the rejected chips due to their width or length being greater than the aperture dimensions of the screen.

It is accordingly an object of the present invention to provide a screening apparatus for wood chips or the like which avoids the deficiencies and disadvantages of the known screening apparatus.

It is a further object of the present invention to provide a screening apparatus of the described type which has a simplified construction with very few moving parts, thus providing for low maintenance costs and greater operational reliability.

It is still another object of the present invention to provide a screening apparatus of the described type which has a large screening area compared to the total area of the apparatus, which is insensitive to impurities such as sand, stones and the like, and which requires little power.

These and other objects and advantages of the present invention are achieved in the embodiment illustrated herein by the provision of a screening apparatus which comprises a frame, and deck means supported by the frame so as to permit relative movement therebetween. The deck means includes at least one deck which has at least one screening section disposed along its length. Each screening section includes an opening in the deck, a stationary grid fixedly mounted to the frame and disposed within the opening of the deck, and a movable grid fixedly mounted to the deck and also disposed within the opening. The stationary grid comprises a plurality of elongate, parallel rod elements which extend in the longitudinal direction and are laterally spaced apart a uniform distance. The movable grid comprises a plurality of elongate parallel rod elements which extend parallel to the rod elements of the stationary grid, and the rod elements of the movable grid alternate between the rod elements of the stationary grid so as to form substantially uniform and uninterrupted gaps between all adjacent pairs of rod elements. The apparatus further includes drive means for imparting reciprocal movement to the deck means, with the reciprocal movement including vertical and longitudinal components so as to be adapted to toss the material which is deposited upon the deck longitudinally toward the discharge end. By this arrangement, the portion of the particulate material being screened having a thickness less than the dimension of the gaps will fall between the rod elements, and the portion having a greater thickness will move longitudinally to the discharge end.

In a preferred embodiment, the apparatus includes a plurality of screening sections disposed serially along the longitudinal length of the deck and each of the screening sections comprises an opening, a stationary grid, and a movable grid as described above. Also, the screening apparatus may include a second deck disposed in spaced relation below the first mentioned deck, with the second deck having a plurality of screening sections which generally correspond to the screening sections of the upper deck, except that the spacing of the gaps is less than that of the spacing of the gaps in the screening sections of the upper deck. Thus, the second or lower deck is adapted to receive the chips of proper thickness which have passed through the gaps of the upper deck, and the sawdust and other fine debris passes therethrough.

Where the apparatus includes a plurality of serially aligned screening sections as described above, it is possible to supply unscreened chip material to both the first screening section and to one or more of the downstream sections of the upper deck. In such case, it is preferable to arrange a flow spreading device in conjunction with each screening section to which unscreened chip material is supplied, to spread the material transversely across the screening section. It is also desirable to position a material lifting and shifting means in conjunction with one or more of the screening sections, which is supplied with chip material from a section located immediately upstream, in order to lift and shift the chips as they flow out onto the associated screening section. Such lifting and shifting will ensure that all chip material comes into contact with the screening surface during its passage, in that the flow is spread uniformly across the width of the screen, and also, any coherent chip cakes may be broken. The lifting and shifting means also serves to increase the efficiency of the screening apparatus by stirring the flow of chips, since a certain amount of oversized chips are usually collected in the lower layer which is in direct contact with the screen after the flow has moved along a portion of the total length of the screen. Such lower layer of oversized chips thus prevents the above layer, having a greater percentage of acceptable chips, from coming into contact with the screen. If desired, a number of devices of this type may be placed in the flow direction, to lift and shift the chips so that they do not lie flat in the lowermost layer and block the gaps, to thereby increase the efficiency and capacity of the apparatus significantly.

In accordance with the present invention, it is highly desirable that the grids of the screening sections be arranged and aligned with each other to form parallel and uniform gaps between the respective rod elements of the stationary grid and the movable grid, and that each gap has a predetermined and constant width and is at least substantially free from members protruding laterally from the rod elements which would tend to limit the gap and obstruct the chip material. In a preferred embodiment, the rod elements of one of the grids have a generally circular cross section, and the rod elements of the other grid have a generally rectangular cross section, and the grids are mounted so that the longitudinal axes of the circular rod elements lie in a common plane which does not extend above the plane defined by the upper surfaces of the rectangular rod elements during the reciprocal movement of the deck means.

Some of the objects and advantages of the invention having been stated, other objects and advantages will appear as the description proceeds, when taken in conjunction with the accompanying, somewhat schematic drawings, in which FIG. 1 is a side elevation view of a screening apparatus in accordance with a preferred embodiment of the invention;

Figure 1:
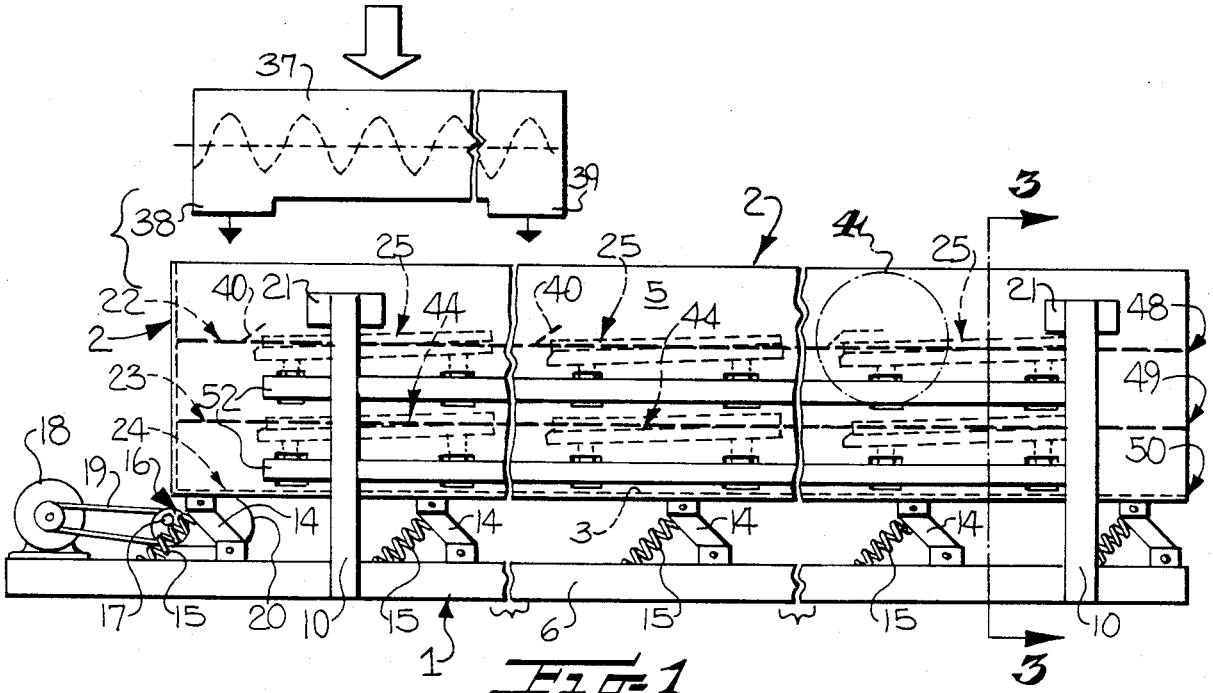
Figure 2:
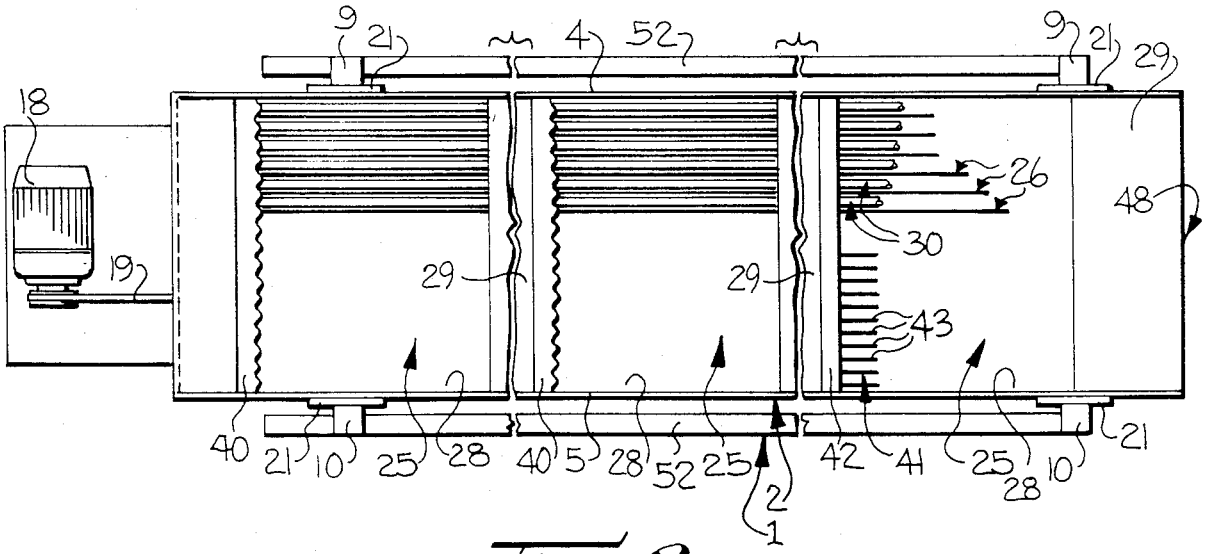
FIG. 2 is a top plan view of the screening apparatus shown in FIG. 1.

Referring more particularly to the drawings, a screening apparatus is illustrated which comprises a frame 1 secured to a foundation (not shown), and an elongate substantially horizontal deck means 2 which is supported by the frame to permit relative movement therebetween in the manner further described below. The deck means 2 comprises a bottom wall 3 and two side walls 4 and 5 which are spaced a predetermined distance apart to define a generally U-shaped channel. The frame 1 comprises two outer and two inner horizontal, parallel support beams 6 and 7 respectively, and two or more support members 8 rigidly interconnecting the support beams. Further, the frame includes two vertical side posts 9 and 10 on each side of the apparatus. Two horizontal parallel side beams 52 rigidly interconnect the side posts 9 and 10, with the side beams 52 extending along the sides of the deck means 2. Also, the side beams 52 on each side of the apparatus are interconnected by a number of upper and lower horizontal cross members 11 and 12 which are spaced apart a predetermined distance and which extend freely through openings 13 in the side walls 4 and 5 of the deck means 2. The deck means 2 is supported by a plurality of link arms 14 and springs 15 arranged between the inner support beams 7 of the frame and the bottom wall 3 of the deck means. More particularly, the link arms 14 are pivotally mounted to the deck means and frame along parallel axes which are perpendicular to the longitudinal direction of the apparatus, and such that lateral relative movement is precluded.

The apparatus also comprises drive means 16 mounted on a stand and operatively connected to the deck means 2 in order to impart a reciprocal movement to the deck means, with the amplitude of the movement being adjustable. In the illustrated embodiment, the drive means includes eccentric means 17 which is driven by a motor 18 via a belt 19. The resulting eccentric movement is transmitted to the deck means via a mechanical connection 20. Guide elements 21 are arranged on the vertical side posts 9 and 10 of the frame to permit the desired reciprocal movement of the deck means while preventing lateral movement thereof.

In the illustrated embodiment, the deck means comprises a first generally horizontal deck 22 for receiving the unscreened chip material, a second generally horizontal deck located below the first deck 22, and a third generally horizontal deck 24 which comprises the bottom wall 3 of the deck means. The decks, which are thus located one above the other, are elongate in shape, to define a material receiving end at the left as seen in FIG. 1, and a longitudinally separated material discharge end at the right. Also, each deck is mounted between the side walls 4 and 5, and is provided with an outlet 48, 49 and 50, respectively.

Figure 3:
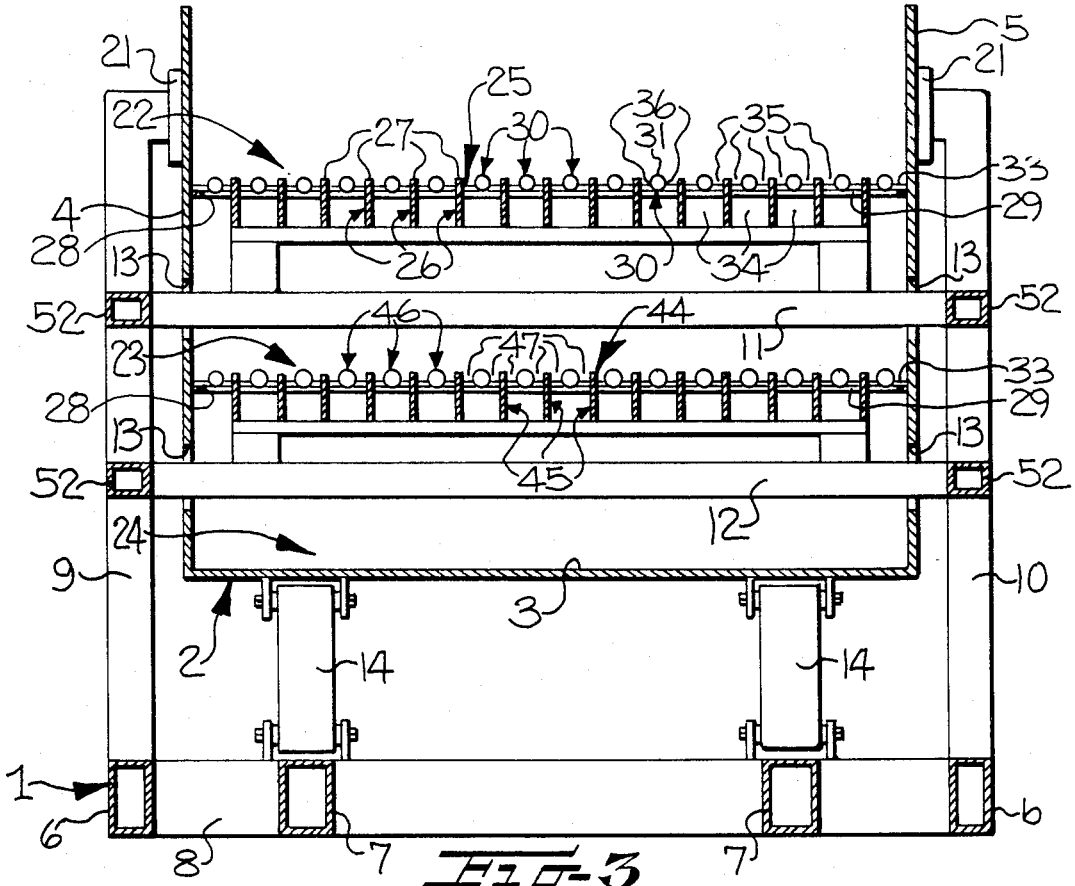
FIG. 3 is a sectional end elevational view of the apparatus taken substantially along the line 3—3 of FIG. 1.
Figure 4:
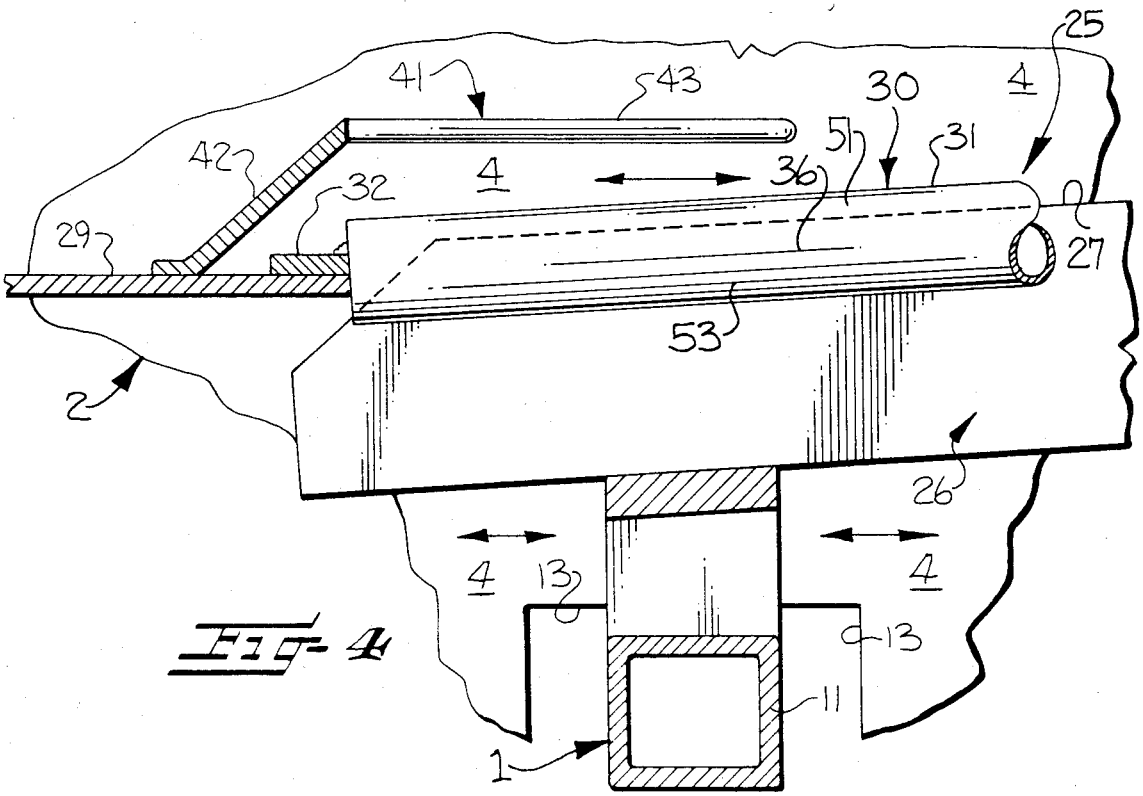
FIG. 4 is an enlarged fragmentary detail view taken within the circle 4 of FIG. 1.

A plurality of screening sections 25 are disposed serially along the longitudinal length of the upper deck 22. Each of the screening sections comprises a generally rectangular opening 28 therein, the longitudinal ends of which are defined by the traverse portions 29 of the deck. Further, each screening section comprises a stationary grid which is fixedly mounted to the frame and disposed within the opening 28 of the deck 22. The stationery grid comprises a plurality of elongate, parallel rod elements in the form of flat bars 26 of rectangular cross section. The bars 26 are oriented so as to be standing on edge and aligned in the longitudinal direction of the apparatus, i.e. in the feed direction of the material. The upper edge surfaces 27 of the bars are located in a common plane, and the bars are arranged so as to be laterally spaced apart a uniform distance from each other. In addition, the bars 26 are fixed at their ends to the upper cross members 11 of the frame in the manner best seen in FIG. 3. The bars 26 are free from contact with the transverse portions 29 which define the ends of the opening 28, and they are spaced from the edges of the opening so that the movement of the deck means 2 is not transmitted to the bars 26 of the stationary grid.

Each screening section 25 also includes a movable grid which is fixedly mounted to the deck 22, and which is composed of a plurality of elongate parallel rod elements which extend parallel to the rod elements 26 of the stationary grid. Further, the rod elements of the movable grid are in the form of tubes 30 which alternate between the rod elements 26 of the stationary grid so as to form substantially uniform and uninterrupted gaps between all adjacent pairs of rod elements 26 and 30. The tubes 30 define longitudinal axes which lie in a common plane, and the tubes are spaced a constant and predetermined distance apart. Also, the tubes are rigidly attached at their ends to the cross pieces 32, 33, which in turn are rigidly mounted to the portions 29 forming the end boundaries of the opening 28. Thus the movable grid is adapted to move in the same manner as the upper deck 22 of the deck means 2. More particularly, the movable grid is located in the opening 28 in the upper deck 22 so that the two grids are received in and aligned with each other. The tubes 30 of the movable grid unit are lowered a predetermined distance into the uniform spaces 34 formed between the inner flat edges of the bars 26 of the stationary grid. The flat bars 26 and the tubes 30 thus form between them parallel, uniform gaps 35 which extend linearly in the longitudinal direction of the screening apparatus, i.e. from the upstream end of the screening apparatus toward its downstream end, and with a constant predetermined gap width. This gap width remains constant during the entire reciprocal movement, and the gaps 35 are entirely free from protruding members such as fingers or lateral plates or the like projecting from the flat bars or tubes and which might have a detrimental effect in limiting the gap both longitudinally and transversely, and thus obstructing the flow of material and the passage of chips. As a result, the chips will be sorted only according to thickness which generally constitutes the smallest dimension of the chips and is considerably smaller than the other two dimensions.

The portion of the chips passing through the screening sections 25, i.e. the accept, will therefore contain chips having the desired maximum thickness or less, but having widths and lengths varying in size depending on the conditions prevailing during chopping of the chips.

In the embodiment illustrated, each screening section 25 is inclined upwardly toward the downstream end of the apparatus, which may be effected by appropriately inclining the planes of the movable and stationary grids. This inclination of the grids provides a desirable delay in the flow of material so that the chips remain longer on the screening apparatus, and those chips with the desired maximum thickness or less are given a full opportunity of being positioned for passage through the gaps 35. The inclination of the screening sections may alternatively be provided by arranging the deck means 2 or the entire screening apparatus in an inclined orientation.

The tubes 30 of the movable grid have upper edges indicated at 31, and upper surfaces 51 which are arcuate in cross section and thus encompass the upper edges 31. The side surfaces 36 of the tubes are also arcuate in cross section. Thus the predetermined effective width of the gap 35 is therefore defined by a flat bar 26 and the side surface 36 of the adjacent tube 30, and the side surfaces 36 are located a predetermined distance below the upper edge surfaces 27 of the flat bars. Since the tubes 30 have a corresponding arcuate surface 53 on their lower side, the side surfaces 36 have an extremely small vertical dimension. The gap therefore becomes wider below the surfaces 36 so that a widened opening is formed and a chip passing through the gap will have very little surface contact with the tube 30, thus making its passage easier and quicker. As an alternative to circular tubes, circular bars, or quadratic tubes standing on an edge, or the like may be used to achieve a similar result. In all cases however, it is preferable that the elevation of the tubes 30 be such that the side surfaces 36, which usually corresponds to the elevation of the axes of the tubes, do not extend above the upper edge surfaces 27 of the flat bars during the reciprocal movement.

A chip feeding apparatus in the form of a screw conveyor 37 is mounted above the screening apparatus. The screw conveyor 37 includes a central feeding shaft, and a right hand threaded and a left hand threaded screw portion. Also, two discharge ducts 38, 39 are located at the ends of the feeding apparatus, through which the chip material is fed to the first deck 22 of the screening apparatus at each of the first and second screening sections 25. The upper deck 22 is provided with a flow spreading device 40 below each chip supply location. Each device 40 is in the form of a plate which is inclined in the flow direction of the chips and extends transversely across the deck immediately before each screening section. In the embodiment shown, the devices 40 are toothed, however they may be designed in a plurality of ways to achieve the desired favorable spreading of the flow of chips laterally across the deck.

Means are also provided for lifting and shifting (i.e. tilting) the chip material as indicated at 41. The lifting and shifting means 41 is arranged at the upstream end of each screening section, and comprises a plate 42 which is inclined in the direction of the flow of chips and which extends transversely across the deck and is secured to the portions 29. A plurality of longitudinally extending, rod-like fingers 43 protrude from the plate 42. The lifting and shifting aeans has a desirable effect on the flow of the chips, since the chips are displaced and lifted in relation to each other and are subjected to changes of direction so that the flow of the chips will contain more air and the chips will be oriented in a better manner in order to more quickly come to a position for feeding through the gaps, assuming that the chips have the proper thickness.

The illustrated embodiment of the screening apparatus further includes a second or intermediate deck 23 which has substantially the same construction as the first or upper deck 22. The second deck 23 is disposed immediately below the first deck 22, and includes a plurality of screening sections 44 along its length which correspond in number to the number of screening sections 25 in the deck 22, and the sections 44 are vertically aligned with respective ones of the sections 25. Each section 44 comprises an opening, a stationary grid composed of rod elements in the form of flat bars 45, and a movable grid having rod elements in the form of tubes 46 arranged in the same way as described above in connection with the sections 25 of the deck 22. However, the tubes 46 of the sections 44 are somewhat larger in diameter (or the spaces between the flat bars 45 may be slightly smaller) so that the gap 47 formed between each flat bar and a tube 46 is more narrow than the corresponding gap 35 in the upper deck 22. The width of the gap 47 is selected so that sawdust, sand, gravel and similar small particles are separated out when the portion of the acceptable chips is fed along the deck 23. The small particles thus separated are collected and fall onto the third or lower deck 24, which is formed by the bottom wall 3 of the deck means. If desired, the screening sections 44 of the second deck 23 may be provided with devices corresponding to the lifting and shifting means 41 of the upper deck 22 in order to achieve favorable alteration in the flow of chips with respect to the relative positions of the chips and the position of each individual chip.

The outlets 48, 49 and 50 provided at the downstream ends of the decks may be connected in a suitable manner to respective receiving stations. The oversized chips are fed from the first or upper deck 22, and may be subjected to further disintegration in order to reduce their thickness. Chips of the desired thickness are fed from the second deck 23, and sawdust, sand, gravel, and similar small particles are fed from the third or lowest deck 24.

The drive means 16 as described above imparts a reciprocal movement to the deck means 2, including the decks 22, 23, and 24. More particularly, the reciprocal movement includes vertical and longitudinal components so as to toss the material being screened longitudinally toward the discharge end of each screening section and toward the outlets 48, 49, and 50. The amplitude of the tossing movement is dependent on the power of the drive means. Thus the deck means will be seen to also function as an efficient transporting means for forwardly feeding the chips, sawdust, etc. along the deck in question. The tossing movements cause the chips to constantly assume new positions and alignments, thus increasing their prospects of arriving in the correct position to enable them to pass through the gaps, provided that their thickness is less than the width of the gaps. This gap searching effect is strengthened by reason of the arcuate upper surfaces 51 of the tubes and which are inclined toward the gaps 35 so that the individual chips are inclined and then raised on edge by adjacent chips. The chips are then held upright in gentle contact with the flat side surfaces of the flat bars, and at the same time are thrown to a greater or lesser extent upwardly and forwardly so that they are able to eventually fall through a gap if their thickness permits.

The length of the screening area necessary for the screening apparatus is determined by capacity requirements. For normal capacity requirements the length of the screening apparatus is such that only one drive means is necessary.

The screening apparatus of the present invention will be seen to be considerably more simple in construction than previously used apparatus for thickness screening. Also, the apparatus of the present invention has few movable parts, and consequently, the maintenance costs are lower and the operation more reliable. Further, the present screening apparatus has a large screening area for a given total size, it is insensitive to impurities such as sand, stones, and the like, and its power requirement is low. Since the chip material may be supplied to the screening apparatus at more than one point along its length, the risk of the cross sectional height of the flow of chips becoming so great that the uppermost layer of chips does not come into contact with the screening sections, is effectively eliminated. Furthermore, the capacity of the apparatus may be readily changed by varying the tossing angle of the deck means, the speed of rotation of the eccentric drive means, or the inclination of all or some of the screening sections.

In an alternative and non-illustrated embodiment, the grids of the intermediate deck may be replaced by one or more perforated screening plates. If sawdust need not be separated from the chip material, the intermediate deck may be totally omitted, in which case the accept is collected and fed along the bottom wall of the deck means. Also, in such case, the lower deck may be arranged more closely to the upper, actual screening deck.

The screening apparatus as shown preferably has six screening sections, the first screening section being followed by another two of the same type as the last screening section (including the means 41) which is preceded by a screening section of the same design (including the means 41).

When the screening apparatus comprises a plurality of screening sections, a lateral outlet may be arranged at a suitable point or points along the length of the apparatus, and particularly before the second supply location for the unscreened chips. Thus the oversized material may be removed through the lateral outlet. Such lateral outlets may also be arranged in the other decks.

The reciprocal movement may be effected by a drive means other than the illustrated eccentric transmission, such as one including a crank, a directly connected piston-cylinder arrangement, or an electromagnet.

In the drawings and specification, there has been illustrated a preferred embodiment of the invention, and although specific terms are employed, they are used in a generic and descriptive sense only and not for purposes of limitation.

That which is claimed is:

1. A screening apparatus for separating a particulate material, such as wood chips, according to thickness, and comprising a frame, deck means supported by said frame so as to permit relative movement therebetween, said deck means including at least one deck defining a material receiving end and a longitudinally separated material discharge end, at least one screening section disposed along said one deck and comprising (a) an opening in said deck (b) a stationary grid fixedly mounted to said frame and disposed within said opening, said stationary grid comprising a plurality of elongate, parallel rod elements which extend in the longitudinal direction and are laterally spaced apart a uniform distance, and (c) a movable grid fixedly mounted to said deck, said movable grid comprising a plurality of elongate parallel rod elements which extend parallel to the rod elements of said stationary grid, and with the rod elements of said movable grid alternating between the rod elements of said stationary grid so as to form substantially uniform and uninterrupted gaps between all adjacent pairs of rod elements, drive means operatively interconnecting said frame and said deck means for imparting reciprocal movement to said deck means, with said reciprocal movement including vertical and longitudinal components so as to be adapted to toss the material deposited at said material receiving end longitudinally along said screening section and toward said discharge end, whereby the portion of the particulate material being screened having a thickness less than the dimension of said gaps will fall between the rod elements, and the portion having a greater thickness will move longitudinally to said discharge end.

2. The screening apparatus as defined in claim 1 wherein said rod elements of one of said grids have an arcuate curvature in cross section on each side, and said rod elements of the other of said grids have flat sides, and wherein the point of minimum separation within each of said gaps does not extend above the upper surfaces of said rod elements of either one of said grids during the reciprocal movement of said deck means.

3. The screening apparatus as defined in claim 1 wherein said rod elements of said movable grid are circular in cross section and define longitudinal axes lying in a common plane, and said rod elements of said stationary grid have a generally rectangular cross section, with said rectangular rod elements having upper surfaces lying in a common plane, and said grids are mounted so that the longitudinal axes of said circular rod elements do not extend above the plane defined by the upper surfaces of the rectangular rod elements during the reciprocal movement of said deck means.

4. The screening apparatus as defined in claim 3 wherein said grids are disposed in parallel planes which are inclined upwardly in the direction toward said discharge end.

5. The screening apparatus as defined in claim 1 wherein said deck means further comprises a second deck disposed in spaced relation below said first mentioned deck, said second deck having at least one screening section disposed therealong which comprises (a) an opening in said second deck, (b) a stationary grid fixedly mounted to said frame and disposed within said opening of said second deck, said second stationary grid comprising a plurality of elongate parallel rod elements which extend in the longitudinal direction and are laterally spaced apart a uniform distance, and (c) a second movable grid fixedly mounted to said second deck, said second movable grid comprising a plurality of elongate parallel rod elements which extend parallel to the rod elements of the associated stationary grid, and with the rod elements of the second movable grid alternating between the rod elements of the second stationary grid so as to form substantially uniform and interrupted gaps between all adjacent pairs of rod elements, and with the dimension of said gaps between the rod elements of said screening unit along said second deck being less than that of said screening unit along said first mentioned deck.

6. The screening apparatus as defined in claim 5 wherein said deck means further comprises a third deck disposed in spaced relation below said second deck, said third deck comprising a bottom wall for supporting the screened material which passes through the screening sections of each of said first and second decks.

7. A screening apparatus for separating a particulate material, such as wood chips, according to thickness, and comprising a frame, deck means supported by said frame so as to permit relative movement therebetween, said deck means including a generally U-shaped channel member having a bottom wall and opposite side walls, and at least one deck extending between said side walls and defining a material receiving end and a longitudinally separated material discharge end, a plurality of screening sections disposed serially along the longitudinal length of said one deck, each of said screening sections comprising (a) an opening in said deck, (b) a stationary grid fixedly mounted to said frame and disposed within said opening, said stationary grid comprising a plurality of elongate, parallel rod elements which extend in the longitudinal direction and are laterally spaced apart a uniform distance, (c) a movable grid fixedly mounted to said deck, said movable grid comprising a plurality of elongate parallel rod elements which extend parallel to the rod elements of said stationary grid, and with the rod elements of said movable grid alternating between the rod elements of the stationary grid so as to form substantially uniform and uninterrupted gaps between all adjacent pairs of rod elements, drive means operatively interconnecting said frame and said deck means for imparting reciprocal movement to said deck means, with said reciprocal movement including vertical and longitudinal components so as to be adapted to toss the material longitudinally along said screening sections and toward said discharge end of said deck, whereby the portion of the particulate material being screened having a thickness less than the dimension of said gaps of said screening sections will fall between the rod elements, and the portion having a greater thickness will move longitudinally along the serially arranged screening sections to the discharge end of the deck.

8. The screening apparatus as defined in claim 7 further comprising material delivery means for depositing a material to be screened upon the upstream end of at least two of said screening sections.

9. The screening apparatus as defined in claim 8 further comprising material spreading means positioned at the receiving end of said at least two screening sections, for laterally spreading the received material across such screening sections.

10. The screening apparatus as defined in claim 7 further comprising means mounted at the upstream end of at least one of said screening sections for lifting and shifting the material to facilitate passage of the material through the gaps of such screening section.

11. The screening apparatus as defined in claim 10 wherein said material lifting and shifting means comprises a plurality of longitudinally extending rod-like fingers disposed laterally across and above the associated screening section.

12. The screening apparatus as defined in claim 7 wherein said deck means comprises a second deck extending between said side walls of said deck means and generally parallel to and beneath said first mentioned deck, and said apparatus further comprises a plurality of screening sections disposed serially along the longitudinal length of said second deck, each of said screening sections of said second deck comprising (a) an opening in said second deck, (b) a second stationary grid fixedly mounted to said frame and disposed within said opening of said second deck, said second stationary grid comprising a plurality of elongate, parallel rod elements which extend in the longitudinal direction and are laterally spaced apart a uniform distance, (c) a second movable grid fixedly mounted to said second deck, said second movable grid comprising a plurality of elongate parallel rod elements which extend parallel to the rod elements of said second stationary grid, and with the rod elements of the second movable grid alternating between the rod elements of said second stationary grid so as to form substantially uniform and uninterrupted gaps between all adjacent pairs of rod elements of said second grids, and wherein the dimensions of said gaps between said pairs of rod elements of said grids of said second deck are less than the dimension of the gaps between the adjacent pairs of rod elements of said grids of said first deck.

13. The screening apparatus as defined in claim 12 wherein the number of screening sections along said second deck corresponds to the number of screening sections along said first deck, and wherein cooperating pairs of screening sections are vertically aligned.

14. The screening apparatus as defined in claim 12 wherein said bottom wall of said U-shaped channel comprises a third deck disposed below said first mentioned and said second decks for receiving that portion of the material which passes through said screening sections of said second deck.

15. The screening apparatus as defined in claim 14 further comprising means mounting said deck means to said frame and comprising a plurality of arms pivotally mounted to both said deck means and said frame along parallel axes which are perpendicular to the longitudinal direction, and guide means for precluding relative lateral movement between said deck means and frame.

16. The screening apparatus as defined in claim 14 wherein said rod elements of each of said movable grids are circular in cross section and define longitudinal axes lying in a common plane, and said rod elements of each of said stationary grids are generally rectangular in cross section, with said rectangular rod elements having upper surfaces lying in a common plane, and said grid units are mounted so that the longitudinal axes of said circular rod elements do not extend above the plane defined by the upper surfaces of the rectangular rod elements during the reciprocal movement of said deck means.

17. The screening apparatus as defined in claim 14 wherein said grids of all of said screening sections are inclined upwardly in the direction toward said discharge end.

* * * * *

UNITED STATES PATENT AND TRADEMARK OFFICE

CERTIFICATE OF CORRECTION

PATENT NO. : 4,504,386

DATED : March 12, 1985

INVENTOR(S) : Karl E.A. Dyren and Gustaf S. Strandberg

It is certified that error appears in the above-identified patent and that said Letters Patent is hereby corrected as shown below:

Column 6, line 58, "aeans" should be -- means -- .

Column 9, line 67, "interrupted" should be -- uninterrupted --

Signed and Sealed this

*Twenty-sixth* Day of *November 1985*

[SEAL]

*Attest:*

DONALD J. QUIGG

*Attesting Officer*

*Commissioner of Patents and Trademarks*